US008960330B2

(12) United States Patent
Leising et al.

(10) Patent No.: US 8,960,330 B2
(45) Date of Patent: Feb. 24, 2015

(54) SYSTEM AND METHOD FOR DIRECTIONAL DRILLING

(75) Inventors: Larry J. Leising, Missouri City, TX (US); Troy Nason, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 622 days.

(21) Appl. No.: 13/306,587

(22) Filed: Nov. 29, 2011

(65) Prior Publication Data

US 2012/0145462 A1 Jun. 14, 2012

Related U.S. Application Data

(60) Provisional application No. 61/422,794, filed on Dec. 14, 2010.

(51) Int. Cl.
*E21B 7/04* (2006.01)
*E21B 7/06* (2006.01)

(52) U.S. Cl.
CPC ..... *E21B 7/067* (2013.01); *E21B 7/062* (2013.01)
USPC ..... 175/61; 175/73

(58) Field of Classification Search
USPC ..... 175/61, 62, 73, 74, 75
See application file for complete search history.

(56) References Cited

U.S. PATENT DOCUMENTS 5,139,094 A * 8/1992 Prevedel et al. ..... 175/61
5,450,914 A * 9/1995 Coram ..... 175/73
6,082,470 A * 7/2000 Webb et al. ..... 175/45
6,237,404 B1 5/2001 Crary et al.
7,805,247 B2 9/2010 Hsu et al.
7,967,081 B2 6/2011 Sugiura et al.
8,004,421 B2 8/2011 Clark
8,111,171 B2 2/2012 Clark
8,121,788 B2 2/2012 Bordakov et al.
8,429,962 B2 4/2013 Zazovsky et al.
8,502,696 B2 8/2013 Clark
2006/0283635 A1* 12/2006 Moody et al. ..... 175/73
2010/0006341 A1 1/2010 Downton
2010/0175925 A1 7/2010 Ciglenec et al.
2010/0201540 A1 8/2010 Li et al.
2011/0276187 A1 11/2011 Ciglenec et al.
2012/0013481 A1 1/2012 Clark
2012/0014219 A1 1/2012 Clark
2012/0145462 A1 6/2012 Leising et al.
2012/0152533 A1 6/2012 Hoefel et al.
2012/0160563 A1 6/2012 Clark et al.
2012/0160565 A1 6/2012 Downton et al.
2013/0022476 A1 1/2013 Villareal et al.
2013/0047696 A1 2/2013 Rasmus et al.
2013/0048380 A1 2/2013 Rasmus et al.
2013/0054146 A1 2/2013 Rasmus et al.

(Continued)

*Primary Examiner* — Giovanna Wright
*Assistant Examiner* — Kristyn Hall
(74) *Attorney, Agent, or Firm* — Chadwick A. Sullivan; Wesley Noa

(57) ABSTRACT

A system and method facilitate directional drilling. The technique employs an orienting tool which may be connected into a coiled tubing drilling system to selectively orient a drilling assembly. The orienting tool is able to cause relative rotation of an outer housing to orientate a tool face. The relative rotation is facilitated by utilizing floating members, such as a floating piston and a floating nut, in the internal orientation assembly. The floating member or members are decoupled in a radial direction to better facilitate the relative rotation of the housing with respect to components of the internal orientation assembly.

20 Claims, 6 Drawing Sheets

(56) References Cited

U.S. PATENT DOCUMENTS

2013/0090854 A1 4/2013 Rasmus et al.
2013/0090855 A1 4/2013 Rasmus et al.
2013/0204534 A1 8/2013 Anand, Vivek et al.
2013/0301389 A1 11/2013 Alford, Jeff et al.

* cited by examiner

TO FIG. 14

SYSTEM AND METHOD FOR DIRECTIONAL DRILLING

CROSS-REFERENCE TO RELATED APPLICATIONS

The present application seeks priority to U.S. Provisional Application 61/422,794, filed Dec. 14, 2010, the entirety of which is incorporated by reference.

FIELD OF THE INVENTION

Aspects relate to directional drilling. More specifically, aspects of the disclosure relate to an orienting tool which may be connected into a coiled tubing drilling system to selectively orient a drilling assembly.

BACKGROUND INFORMATION

In many wellbore drilling applications, reservoir access can be enhanced through directional drilling. Various drilling systems are available to enable directional drilling and the formation of deviated wellbores. For example, coiled tubing drill strings have employed a bent mud motor below an orienter to enable directional steering. Because the bent mud motor slides along with the coiled tubing, the orienter is required to adjust the tool face by adjusting the orientation of the bend to steer the bit. Orienting the bend and steering the bit in this manner enables formation of the well path, and thus the wellbore, in a desired direction.

Conventional orienting tools may be powered through the flow of drilling mud directed downhole and through the orienting tool. However, mud flow controlled devices require substantial time to change the tool face angle. The time lag is unacceptable in various types of applications, such as drilling applications using compressed fluids. Sometimes, the orienting tool also presents difficulties in transmission of data and/or control signals to and from devices located below the orienting tool.

SUMMARY

In general, the present disclosure provides a system and methodology designed to facilitate directional drilling. The technique uses an orienting tool which may be connected into a coiled tubing drilling system to selectively orient a drilling assembly. The orienting tool is able to cause relative rotation between an outer housing and an internal orientation assembly. The relative rotation is facilitated by utilizing floating members, such as a floating piston and a floating nut, in the internal orientation assembly. The floating member or members are decoupled in a radial direction to better facilitate the relative rotation of the orientation assembly. In some embodiments, a communication system also may be employed to facilitate passage of signals through the orienting tool regardless of its orientation.

BRIEF DESCRIPTION OF THE DRAWINGS

Certain embodiments of the disclosure will hereafter be described with reference to the accompanying drawings, wherein like reference numerals denote like elements, and.

DETAILED DESCRIPTION

In the following description, numerous details are set forth to provide an understanding of the present disclosure. However, it will be understood by those of ordinary skill in the art that the present disclosure may be practiced without these details and that numerous variations or modifications from the described embodiments may be possible.

The present disclosure generally relates to a system and methodology which facilitate drilling operations. According to an embodiment, a drilling system, such as a coiled tubing drilling system, employs an orienting tool to cause relative rotation of a housing to orient a tool face. The orienting tool is designed to facilitate the relative rotation with respect to the housing even when the housing is subjected to bending by employing one or more floating members. In an embodiment of the orienting tool, an internal orientation assembly comprises a floating piston which enables rotational control over the orienting tool while facilitating the movement relative to the housing. In some applications, the internal orientation assembly also may comprise one or more floating nuts designed to further facilitate the relative movement without creating binding and without requiring excess clearances when the housing is flexed.

Figure 1:
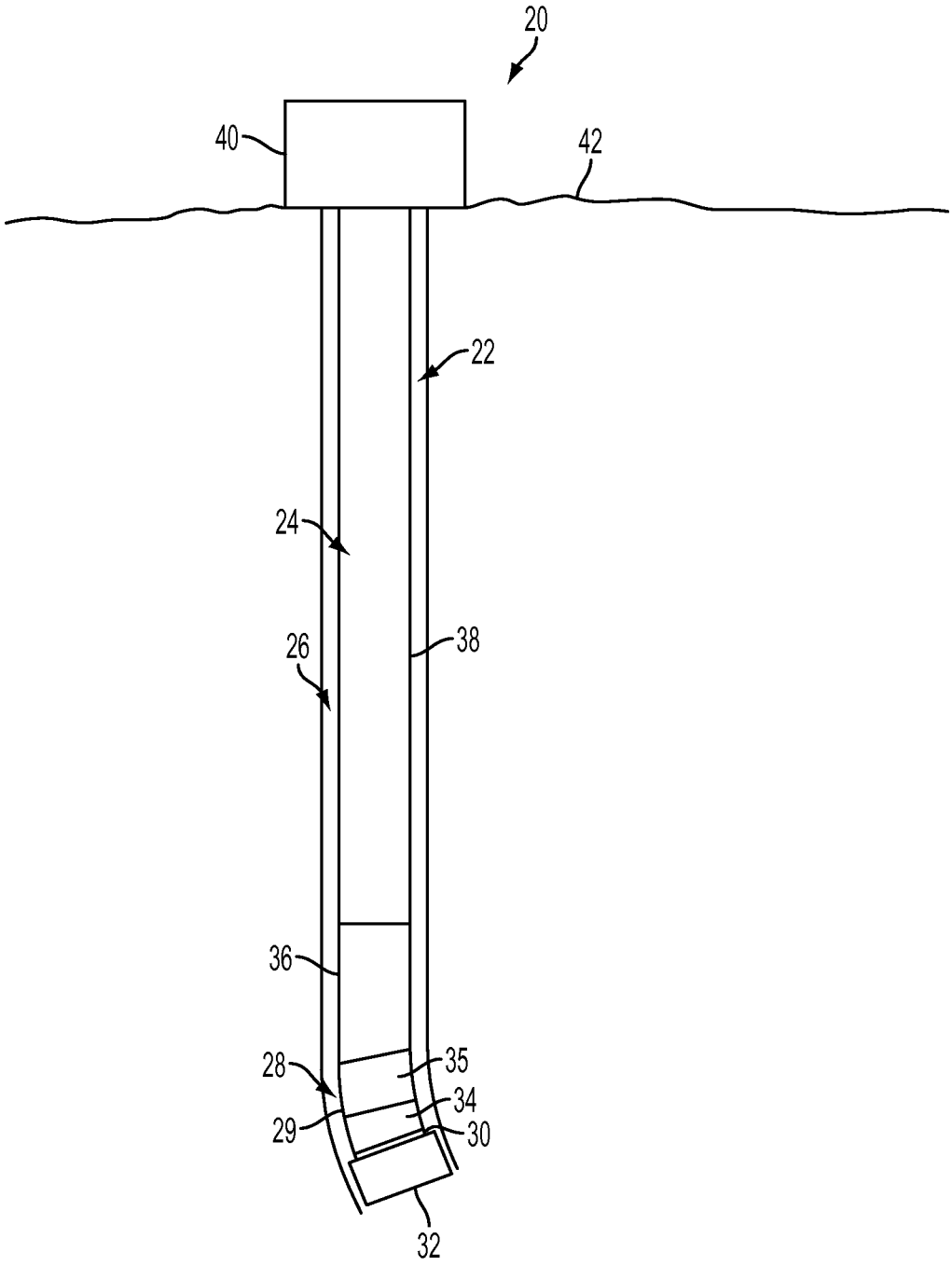
FIG. 1 is a schematic illustration of one example of a drilling system, e.g. a coiled tubing drilling system, positioned in a wellbore and having an orienting tool, according to an embodiment of the present disclosure.

Referring generally to FIG. 1, a well system 20 is illustrated as having a drilling system 22 which may be in the form of a coiled tubing drilling string 24. The drilling system 22 is constructed to enable directional drilling and thus the drilling of a deviated wellbore 26. In the illustrated example, the coiled tubing drilling string 24 comprises a drilling assembly 28, e.g. a bottom hole assembly, designed to rotate a drill bit shaft 30 coupled to a drill bit 32. By way of example, the drilling assembly 28 may comprise a steering section 34 and a suitable power source, such as a drilling motor 35, e.g. a mud motor 35, to rotate the drill bit shaft 30. The drilling assembly 28 also may have a bent housing 29 which may be a bent housing of the mud motor 35 and/or of steering section 34. In one example, drilling motor 35 is a bent housing drilling motor. As illustrated, the coiled tubing drilling string 24 also comprises an orienting tool 36 which is controlled to adjust the tool face orientation of drill bit 32. Tool face orientation is adjusted by changing the rotational orientation of the bent housing 29 and thus of drill bit 32, as described in greater detail below. Properly orienting the bend and steering the bit in this manner enables formation of the desired, deviated well path.

In the embodiment illustrated, orienting tool 36 and drilling assembly 28 are delivered downhole via coiled tubing 38. The coiled tubing 38 may be coupled to orienting tool 36 or to another suitable component of coiled tubing drilling string 24 by a suitable connector. A rig 40 or other suitable surface equipment is employed to deliver the coiled tubing 38 and the overall coiled tubing drilling string 24 downhole to conduct the drilling operation. The surface equipment 40 is positioned at a surface location 42, which may be a land surface or a sea surface.

Figure 2:
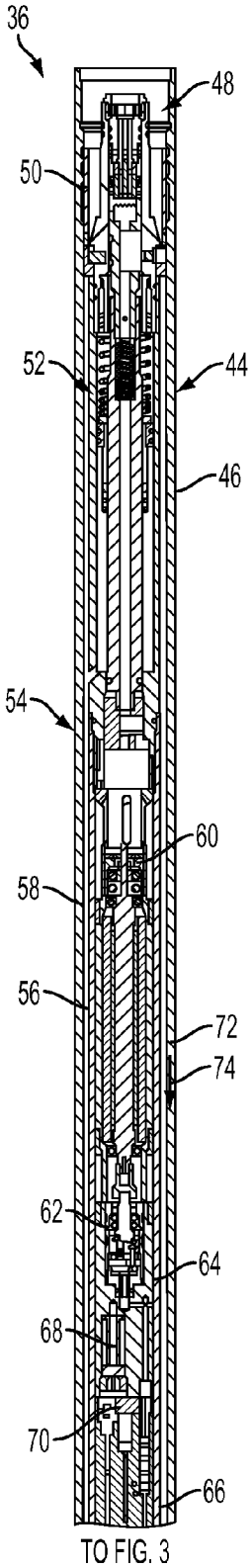
FIG. 2 is a cross-sectional view of a portion of one type of orienting tool, according to an embodiment of the present disclosure.
Figure 3:
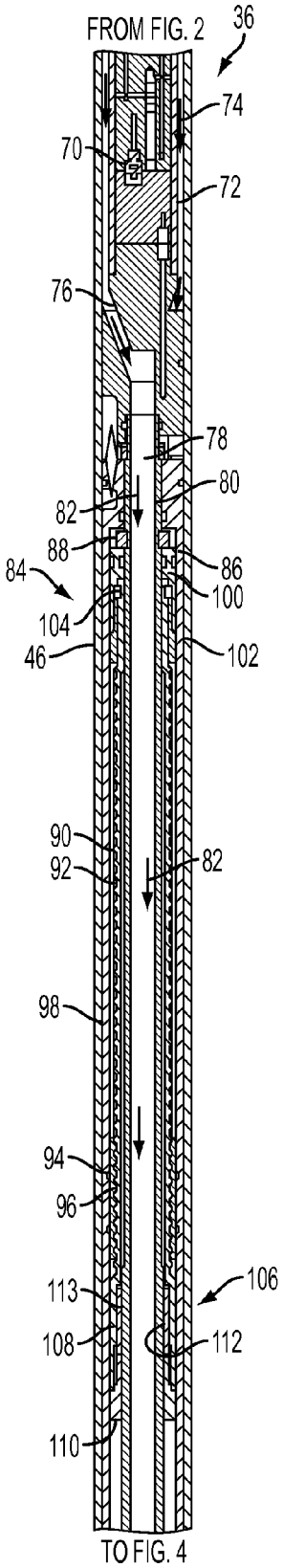
FIG. 3 is a cross-sectional view of another portion of the orienting tool, according to an embodiment of the present disclosure.
Figure 4:
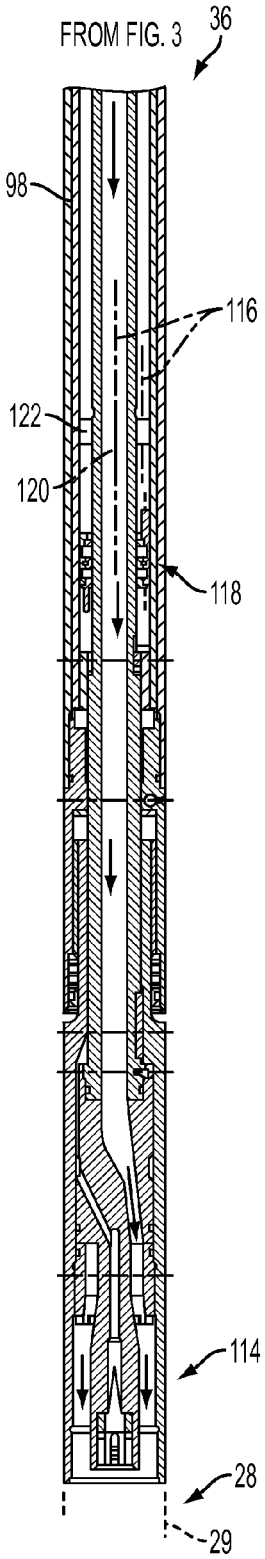
FIG. 4 is a cross-sectional view of another portion of the orienting tool, according to an embodiment of the present disclosure.

Referring generally to FIGS. 2-4, an embodiment of orienting tool 36 is illustrated. In this example, FIG. 2 illustrates an upper section of the orienting tool 36, FIG. 3 illustrates a middle section of the orienting tool 36, and FIG. 4 illustrates a lower section of the orienting tool 36. A variety of orienting tool components are illustrated and described, however components may be added, interchanged, deleted and/or modified to accommodate specific operational or environmental considerations.

As illustrated in FIG. 2, the upper section of orienting tool 36 comprises the upper portion of a drill collar 44 which may be in the form of (or incorporate) a housing 46 which can flex during formation of a deviated wellbore as discussed in greater detail below. Additionally, an electrical tool to tool connector 48 is illustrated at an upper end of the figure as held in place by a jam nut 50. Beneath the connector 48, an oil compensator 52 is located within housing 46. However, oil compensator 52 may be positioned at a variety of locations along the orienting tool 36.

In the example illustrated, a motor and electronics chassis 54 is positioned below oil compensator 52. The chassis 54 is designed to secure various motor and control components, such as a motor 56, a pressure housing 58, and a resolver 60. Resolver 60 may be used to measure and monitor the rotational position of orienting tool 36. The chassis 54 also may be used to mount a variety of control and processing components, depending on the specific design of the drilling system 22. A pump 62 is powered by a motor 56 and may be in the form of a hydraulic pump with pressure transducers. In this example, the differential pressure provides a good indication of the drilling torque. Additionally, the piston may be dithered hydraulically to improve the accuracy of the torque measurement.

Pump 62 may comprise various other features, although the type and form of the additional features can vary depending on the specific construction of orienting tool 36. However, the pump 62 illustrated in FIG. 2 comprises a hydraulic block pump section 64 and a hydraulic block solenoid 66. Additionally, the pump employs an oil filter 68 between the hydraulic block pump section 64 and the hydraulic block solenoid 66. Pressure sensors 70 also may be incorporated to monitor the pump output and pressure buildup during operation of orienting tool 36. In this example, pump 62 is a bi-directional pump to enable changes in rotational position of the orienting tool 36 in either direction. This ability may be helpful in a variety of situations, including situations in which the drilling assembly 28 becomes stuck. Once stuck, the orienting tool 36 may be operated bi-directionally to help free the drilling assembly.

The illustrated orienting tool 36 also comprises flow channels 72 running axially along the drill collar 44 for carrying a mud flow, as represented by arrow 74. The flow channels 72 extend down into the middle section of orienting tool 36, as illustrated in FIG. 3. In this middle section area, a flow diverter 76 is positioned to direct the annular fluid flow from flow channels 72 to an interior flow passage 78 oriented axially along an internal mandrel 80. Consequently, the drilling mud may continue to flow through orienting tool 36 along an interior passage 78, as represented by arrows 82.

As also illustrated in FIG. 3, the orienting tool 36 further comprises an internal orientation assembly 84 located within housing 46. In the example illustrated, the internal orientation assembly 84 is located beneath flow diverter 76 and is positioned around internal mandrel 80 for cooperation with the internal mandrel 80. Selective operation of internal orientation assembly 84 causes the desired changes in rotational position of the orienting tool 36. For example, the internal orientation assembly 84 is operated to cause relative rotational motion of housing 46 to control the orientation of the tool face in the direction of drilling. The relative rotational motion occurs between, for example, the housing 46 and the internal mandrel 80.

In the embodiment illustrated, internal orientation assembly 84 comprises a floating piston 86 which is limited in its upstroke travel by an upstroke shoulder 88. The internal orientation assembly 84 further comprises a spline member 90 having a lateral spline 92, e.g. a spline member 90 having a helical or lateral straight spline 92. The floating piston 86 and lateral spline member 90 are selectively moved in an axial direction by pressurized fluid supplied via pump 62 or by another suitable pressurized fluid source. Axial movement of floating piston 86 causes transverse spline member 90 to move through a nut 94 having a corresponding, internal lateral spline 96. In this embodiment, nut 94 is a floating nut (floating similar to piston 86) to accommodate translational and rotational movement along housing 46 even if housing 46 is flexed. In at least some embodiments, the corresponding lateral spline 96 may be a helical spline or a lateral straight spline with an appropriate size and pitch to work in cooperation with lateral spline 92 of spline member 90.

In the embodiment illustrated, floating piston 86 and spline member 90 are positioned within a piston sleeve 98 which, in turn, is mounted within housing 46. Nut 94 is secured within piston sleeve 98 and housing 46 in a manner which forces the selective change in rotational position of the orienting tool 36 when floating piston 86 and spline member 90 undergo axial translation. For example, the housing 46 can be shifted to a different rotational position relative to internal mandrel 80 to affect the orientation of the bent housing 29 and the tool face orientation of drill bit 32.

Although floating piston 86 and/or floating nut 94 may be constructed in a variety of configurations, the floating nature of one or both of these components facilitates both the rotational and translational movement of orienting tool 36 during changes in rotational position. The floating nature of these components means that the piston 86 and/or nut 94 are decoupled in a radial sense. In other words, these components can shift, e.g. pivot, in a radial direction without transmitting forces to other components of the orienting tool 36. By allowing these components to float rather than being securely attached, flexing movement in the housing 46, e.g. curvature of the housing 46, is accommodated without binding or interference, thus facilitating operation of the orienting tool 36 and the drilling of wellbore 26. Because of the floating nature of piston 86 and/or nut 94, sufficient clearance is provided to accommodate pivoting of these components during rotation and translation through housing 46 when housing 46 is flexed. For example, floating nut 94 may be provided with sufficient clearance to remain substantially coaxial with a surrounding portion of the housing 46 during axial movement of spline member 90 to cause changes in the rotational position of orienting tool 36.

The floating components are designed to accommodate the particular construction of a given collar/housing and/or other components of the orienting tool. By way of example, floating piston 86 may be constructed as a two-part or multipart piston. In this example, floating piston 86 comprises a floating portion 100 and a fixed portion 102, which may be in the form of a jam nut. The floating piston 86 is engaged with spline member 90 by a suitable engagement member 104, such as a split ring, without completely preventing movement of floating portion 100 in a radial direction.

The internal orientation assembly 84 may comprise additional mechanisms for engaging the internal mandrel 80. For example, an engagement mechanism 106 may be mounted at an end of the spline member 90 opposite floating piston 86. In the example illustrated, engagement mechanism 106 comprises a floating nut 108 secured by a jam nut 110. In this example, floating nut 108 has internal axially straight splines 112 which allow axial translation along internal mandrel 80, e.g. along corresponding axially straight splines 113 of mandrel 80, without permitting relative rotational movement with respect to the internal mandrel.

The orienting tool 36 also may comprise additional components, such as a drill assembly connector end 114 by which the orienting tool 36 may be coupled with drilling assembly 28 or with another appropriate, downhole drill string component. In some applications, signals (e.g. power signals and/or data signals) are transmitted through orienting tool 36 via one or more communication lines 116, such as electrical and/or optical fiber communication lines. The changes in rotational position of orienting tool 36 may be accommodated through a variety of mechanisms designed to permit the relative rotation without damaging the communication lines. According to one example, one or more communication lines 116 are coupled with rotating contacts 118 deployed outside internal mandrel 80. In an alternate embodiment, one or more communication lines are routed along interior flow passage 78 within internal mandrel 80 and through a twisting section 120 which allows the communication line to twist along a generally centralized axis of the orienting tool 36. The communication line(s) 116 also may be wound into a spring in a manner which facilitates changes in rotational position of the orienting tool 36.

Figure 5:
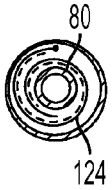
FIG. 5 is a cross-sectional view of an example of a signal communication system within the orienting tool, according to an embodiment of the present disclosure.

In another example, a flex spring 122 may be employed, as illustrated in phantom lines in FIG. 4 and also in FIG. 5. In this embodiment, a flex spring 124 is mounted around internal mandrel 80 in the annular space between internal mandrel 80 and piston sleeve 98. The communication line 116 is mounted to the flex spring 124, and flex spring 124 holds the communication line free of components which could induce friction during operation of orienting tool 36. The communication line mechanisms also may incorporate different types of flex circuits, flex wires, slip rings at rotating interfaces, twist mechanisms, and other techniques/devices to accommodate the rotational positioning of the orienting tool 36. A variety of these communication line mechanisms may be used alone or in combination at various positions along orienting tool 36 to ensure long-term communication of signals through the orienting tool.

Figure 6:
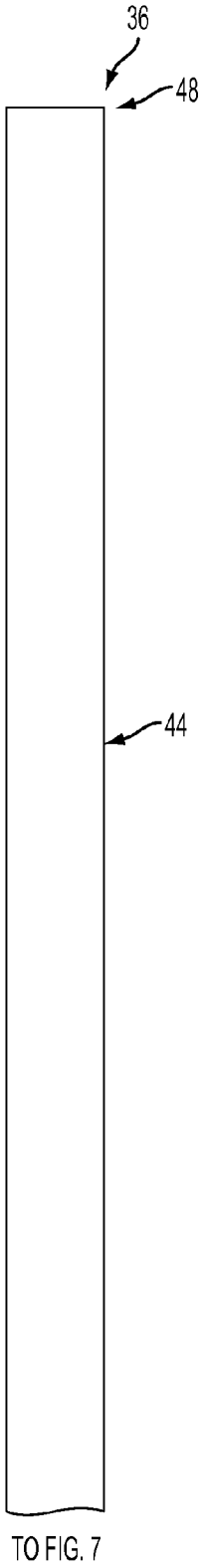
FIG. 6 is a front view of a portion of the orienting tool, according to an embodiment of the present disclosure.
Figure 7:
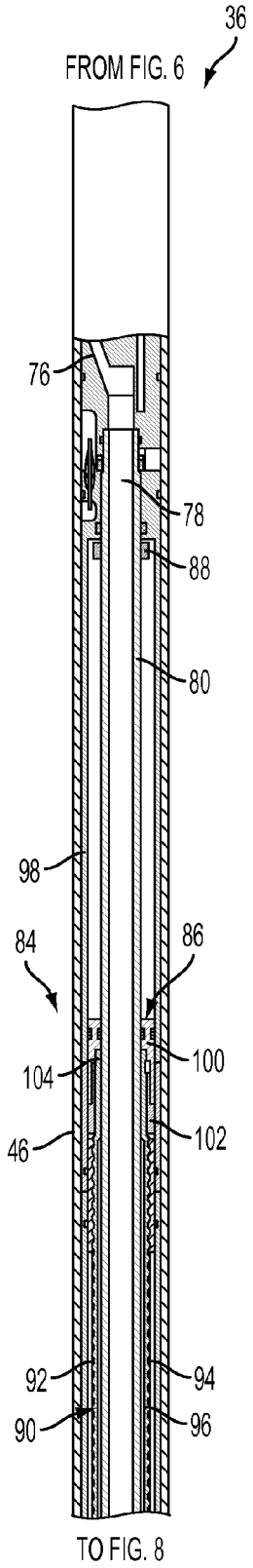
FIG. 7 is a partially broken away cross-sectional view of another portion of the orienting tool showing the piston assembly shifted relative to the position illustrated in FIGS. 3 and 4, according to an embodiment of the present disclosure.
Figure 8:
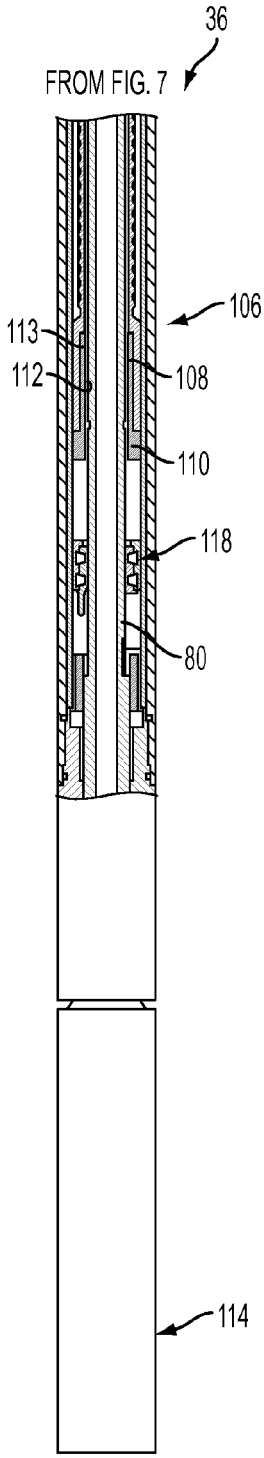
FIG. 8 is a partially broken away cross-sectional view of another portion of the orienting tool showing the piston assembly shifted relative to the position illustrated in FIGS. 3 and 4, according to an embodiment of the present disclosure.

Referring generally to FIGS. 6-8, the upper, middle, and lower sections of orienting tool 36 are again illustrated. In these figures, however, internal orienting assembly 84 is illustrated as having been actuated to a fully downstroked position. In other words, floating piston 86 has been driven in an axial direction through housing 46 to an opposite end, as illustrated best in FIGS. 7 and 8. Of course, as floating piston 86 is driven in the axial direction, movement of the floating piston 86 forces axial translation of spline member 90 through floating nut 94 which imparts relative rotational motion with respect to the outer housing 46. Simultaneously, the second floating nut 108 slides axially along internal mandrel 80 while being prevented from relative rotational movement with respect to internal mandrel 80 via engagement of axially straight splines 112 with corresponding straight splines 113. Accordingly, controlled movement of floating piston 86 and spline member 90 in an axial direction controls the rotational positioning of orienting tool 36 and housing 46.

Figure 9:
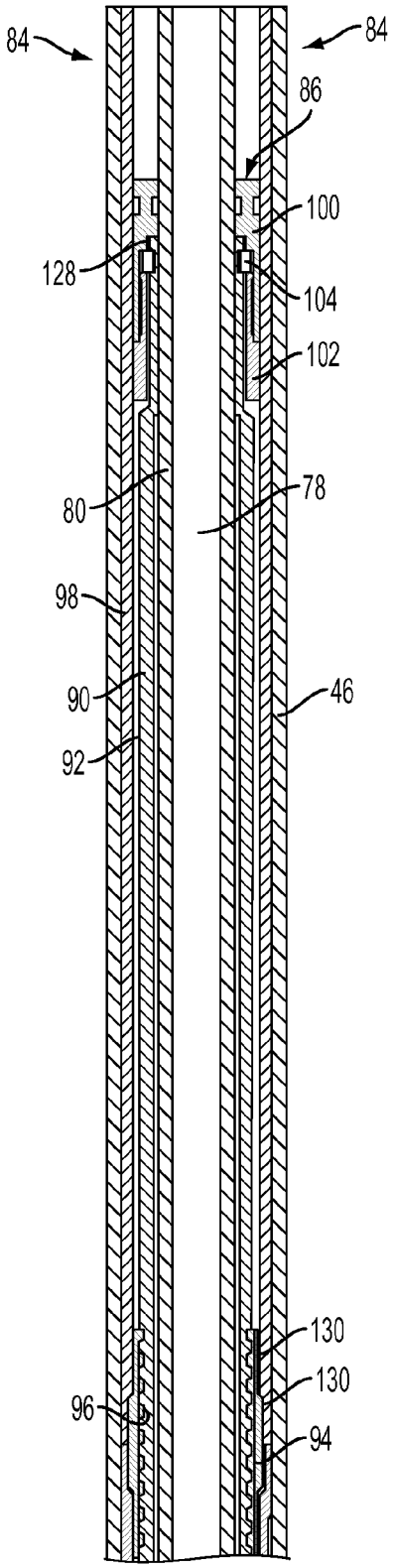
FIG. 9 is a cross-sectional view of a portion of one example of a housing and internal orientation system utilizing a floating piston, according to an embodiment of the present disclosure.
Figure 10:
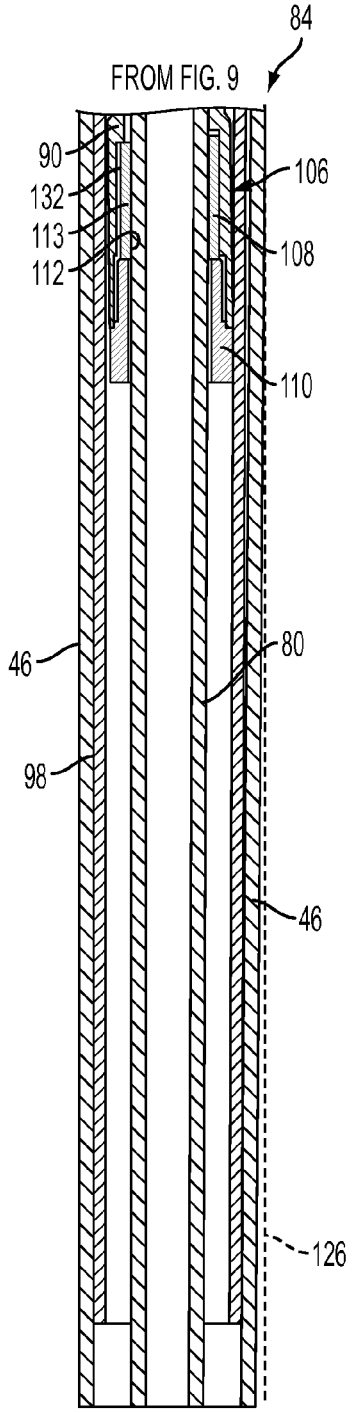
FIG. 10 is a cross-sectional view of another portion of the housing and internal orientation system utilizing a floating piston, according to an embodiment of the present disclosure.

The floating nature of piston 86, nut 94 and nut 108 (individually or collectively) ensures free movement of the orienting tool 36 without binding or stressing of components, as more clearly illustrated in FIGS. 9-12. Referring first to FIGS. 9 and 10, the internal orientation assembly 84 is illustrated at an upstroke position in which spline member 90 is substantially above floating nut 94. As illustrated, the housing 46 is undergoing a bending moment and deviates substantially from a straight line 126 to facilitate directional drilling of deviated wellbore 26 (see FIG. 10).

In this particular embodiment, piston 86, nut 94, and second nut 108 each comprises a floating member which is decoupled from corresponding components in a radial sense or direction. For example, at least a portion, e.g. floating portion 100, of piston 86 is not secured in a radial direction, thus allowing the floating piston 86 to pivot radially during axial transition through housing 46 even when housing 46 undergoes bending due to the drilling of a deviated wellbore section. A sufficient clearance 128 is provided to allow the radial shifting/pivoting of piston 86 during axial translation of spline member 90 and during the resulting changes in rotational position of orienting tool 36.

Nut 94 similarly is not secured in a radial direction which also allows the nut 94 to pivot radially during axial transition of spline member 90 through nut 94. Again, a sufficient clearance 130 is provided to allow radial shifting/pivoting of nut 94 as the lateral spline 96 of nut 94 interacts with the lateral spline 92 of spline member 90. The clearance 130 may be selectively designed so the nut 94 remains coaxial with a surrounding portion of housing 46 during the axial translation of spline member 90. To further accommodate the axial translation of internal orientation assembly 84 along housing 46 without creating points of interference or binding during flexing of housing 46, the second nut 108 is held in an axial location relative to spline member 90 without being secured in a radial direction. Not being secured in the radial direction, allows nut 108 to pivot/shift radially, i.e. float, along internal mandrel 80 during axial translation of spline member 90 through nut 94. A sufficient clearance 132 allows the radial shifting/pivoting of nut 108 as it moves along internal mandrel 80. The clearance 132 also may be selectively designed so nut 108 remains coaxial with a surrounding portion of housing 46 during the axial translation of spline member 90.

Figure 11:
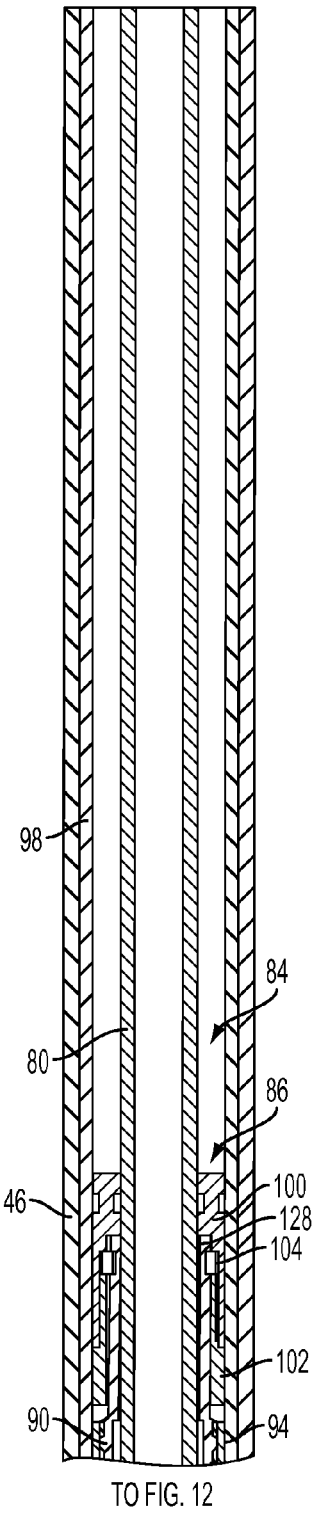
FIG. 11 is a cross-sectional view similar to that of FIG. 9 but showing the floating piston assembly shifted axially, according to an embodiment of the present disclosure.
Figure 12:
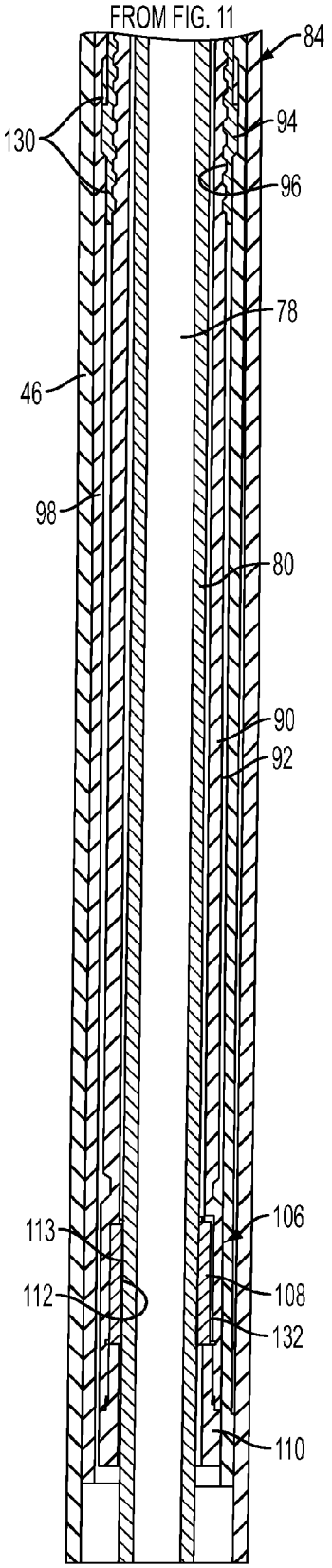
FIG. 12 is a cross-sectional view similar to that of FIG. 10 but showing the floating piston assembly shifted axially, according to an embodiment of the present disclosure.

When sufficient hydraulic pressure is supplied by pump 62 (or another suitable source) to the region illustrated above floating piston 86, the floating piston 86 and spline member 90 are moved axially within housing 46 and piston sleeve 98. As the spline member 90 is moved through nut 94, the axially straight splines 112 of second nut 108 prevent rotation of the spline member 90 with respect to the internal mandrel 80. However, the interaction of lateral splines 96 of nut 94 with corresponding splines 92 of spline member 90 forces relative rotational movement of housing 46, and thus rotational adjustment of the orienting tool 36 and the bottom hole assembly 28. Continued application of pressure against floating piston 86 causes the piston and spline member 90 to move to an opposite end or position, as illustrated in FIGS. 11 and 12. Of course, the actual distance through which spline member 90 is translated through nut 94 depends on the desired rotational position of orienting tool 36. Furthermore, the bi-directional pump 62 enables application of pressure on an opposite side of floating piston 86 and internal orienting assembly 84 to selectively move the spline member 90 in an axial, upstroke direction. During any of these axial movements, the floating nature of piston 86, nut 94, and/or nut 108 along with the corresponding clearances 128, 130, 132 facilitate free movement and dependable orientation of the housing 46 during drilling operations.

Figure 13:
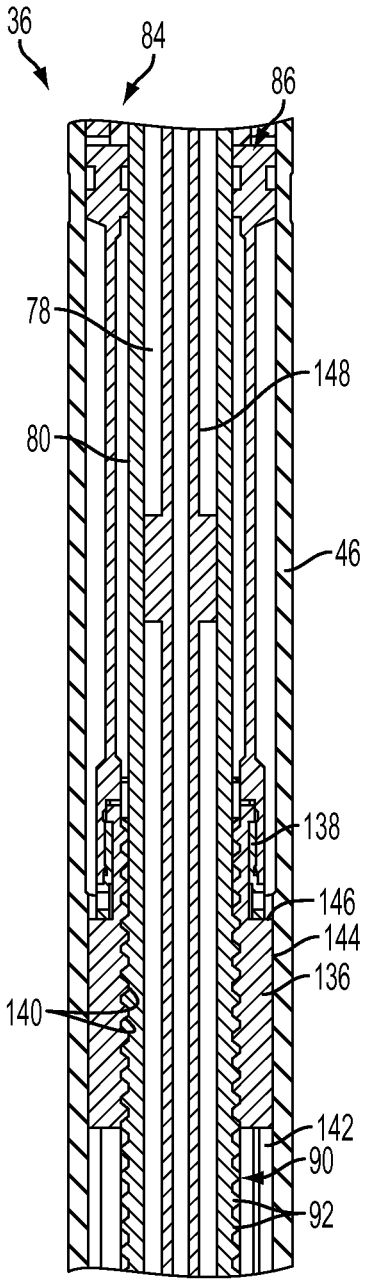
FIG. 13 is a cross-sectional view of a portion of another example of a housing and internal orientation system utilizing at least one floating member, according to an embodiment of the present disclosure.
Figure 14:
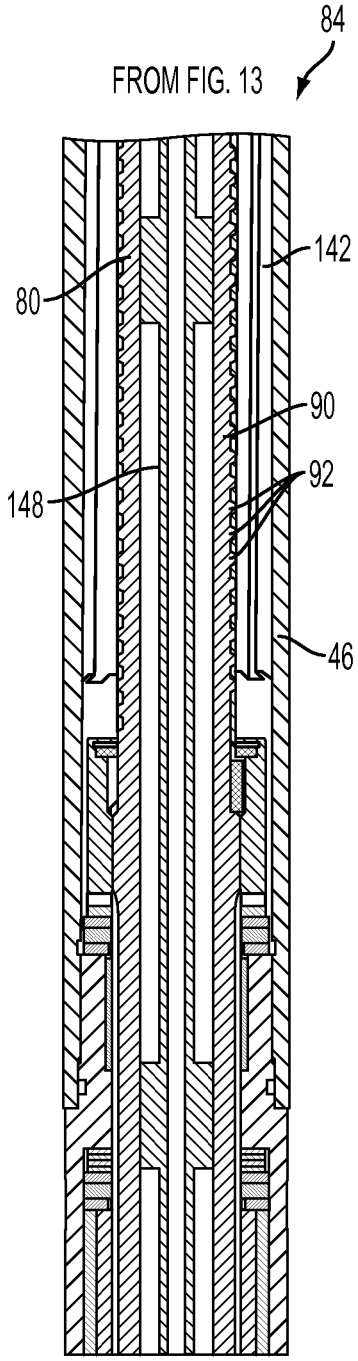
FIG. 14 is a cross-sectional view of another portion of the housing and internal orientation system illustrated in FIG. 13, according to an embodiment of the present disclosure.

Referring generally to FIGS. 13 and 14, another embodiment of internal orientation assembly 84 within housing 46 is illustrated as a portion of the overall orienting tool 36. As discussed above with respect to other embodiments, the orienting tool 36 may comprise a variety of other components and sections to facilitate the desired operation, such as a drilling operation. In the embodiment illustrated, floating piston 86 is coupled with a floating nut 136 via a coupling member 138. As described above, appropriate clearances enable the floating piston 86 and the floating nut 136 to float in a manner which prevents binding when housing 46 is subjected to a bending load.

In this embodiment, a single floating nut 136 may be employed because spline member 90 is incorporated with or formed on internal mandrel 80. Again, the spline member 90 has lateral splines 92, such as helical or lateral straight splines, extending outwardly from an outer surface of internal mandrel 80. The single floating nut 136 comprises internal lateral splines 140, such as helical or lateral straight splines, having appropriate size and pitch for engagement with lateral splines 92 of spline member 90.

The floating nut 136 is secured against rotational movement with respect to housing 46 via one or more axially straight splines 142 which extend along an interior of housing 46. An external surface 144 of floating nut 136 comprises corresponding recesses 146 which receive the axially straight splines 142 of housing 46 to prevent relative rotation between the housing 46 and floating nut 136. In other embodiments, the floating nut 136 may comprise a spline member received in a corresponding recess formed along the internal surface of housing 46; or the floating nut 136 may have other features which cooperate with housing 46 to prevent relative rotation therebetween. The assembly also may incorporate other components, such as an internal tubing 148 for routing communication lines and/or segregated fluid flows.

When sufficient hydraulic pressure is supplied by pump 62 (or another suitable source) to the region illustrated above floating piston 86, the floating piston 86 is moved axially within housing 46 and forces axial movement of floating nut 136. As the floating nut 136 is moved along spline member 90 extending from internal mandrel 80, the axially straight splines 142 extending inwardly from housing 46 prevent rotation of the floating nut 136 with respect to housing 46. However, the interaction of lateral splines 140 of floating nut 136 with corresponding splines 92 of spline member 90 forces relative rotational movement between internal orientation assembly 84/mandrel 80 and housing 46. This relative rotation is used to cause a desired rotational adjustment of the orienting tool 36 and the bottom hole assembly 28, as described above. The actual distance over which floating nut 136 is translated along spline member 90 depends on the desired rotational position of orienting tool 36. Furthermore, pump 62 may comprise a bi-directional pump 62 capable of applying pressure on an opposite side of floating piston 86 and internal orienting assembly 84 to selectively move the floating nut 136 in an axial, upstroke direction. During any of these axial movements, the floating nature of piston 86 and nut 136 along with the corresponding clearances allow flexing movement of housing 46 and dependable orientation of the orienting tool 36 during drilling operations Long-term use also may be promoted by forming interacting components with non-galling materials. For example, piston 86 and nuts 94, 108, 136 may be formed with appropriate non-galling materials, such as hardened copper alloys, e.g. ToughMet®, or beryllium copper alloy materials. The entire component may be formed from the non-galling material, or the component may comprise coatings or inserts of the desired material. Additionally, cooperating components (e.g. spline member 90) or regions of cooperating opponents also may benefit from the addition of low friction/non-galling materials.

Generally, the well system 20 may be constructed with several types of components designed to facilitate a directional drilling operation in a given environment. The orienting tool 36 may be coupled to or combined with a variety of components in a coiled tubing drilling string or other type of drilling string. Furthermore, the orienting tool 36 may have a variety of lengths, sizes, configurations, and componentry depending on the specifics of a given application and drilling environment. Many types of internal components and materials may be incorporated into the overall orienting tool design.

Depending on the drilling application and environment, the size and surface area of piston 86, as well as the pressure provided to move the piston, may vary. Similarly, the size and style of the transverse splines and straight splines may be adapted for specific applications. In some embodiments, the cooperating transverse splines are helical splines and may have individual splines or multiple splines (e.g. two, four or six splines) arranged in a suitable transverse orientation with a suitable pitch. The components and techniques for communicating signals through the orienting tool also may be adjusted for a given application and environment. Several types of communication lines may be routed through the orienting tool with the aid of flex circuits, flex wires, slip rings, spiral springs, twist regions, or other devices which allow the communication lines to be routed down through the central mandrel or along an annular region external to the central mandrel. The orienting tool also may be constructed without certain components, with additional components, with alternate components, and/or with different arrangements of components as needed to facilitate the desired drilling operation.

In one example embodiment, a system for drilling a wellbore is disclosed comprising a drill bit; a steering tool coupled to the drill bit and an orienting tool coupled to the steering tool on a side opposite the drill bit, the orienting tool comprising a piston cooperating with a spline member within a housing to selectively change the rotational position of the orienting tool, the piston being a floating piston cooperating with a floating nut to facilitate directional drilling of the wellbore regardless of a curvature of the orienting tool. In another example embodiment, a system is disclosed comprising an orienting tool having an outer housing, the orienting tool further comprising an internal orientation assembly to cause relative rotation of a bent housing drilling motor to orientate tool face along a drill path, the internal orientation assembly comprising a floating piston, a splined member, and a floating nut which undergoes relative movement with respect to the splined member when at least one of the splined member and the floating nut is acted on by the floating piston; the floating piston, splined member, and floating nut being located radially between an inner mandrel and an outer housing, wherein the floating piston comprises at least a portion which is radially decoupled to float within the housing. In a still further embodiment, a method of orienting in a wellbore is disclosed comprising coupling an orienting tool into a coiled tubing drilling system to orient a drilling assembly, providing the orienting tool with a housing and an internal orientation assembly within the housing, and utilizing a floating piston and a floating nut in the internal orientation assembly to accommodate curvature of the housing during directional drilling.

Although only a few embodiments of the present disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for drilling a wellbore, comprising:

a drill bit;

a steering tool coupled to the drill bit; and an orienting tool coupled to the steering tool on a side opposite the drill bit, the orienting tool comprising a piston cooperating with a spline member within a housing to selectively change the rotational position of the orienting tool, the piston being a floating piston cooperating with a floating nut to facilitate directional drilling of the wellbore regardless of a curvature of the orienting tool, wherein the spline member is disposed through the floating nut and wherein axial translation relative to the spline member and the floating nut imparts rotational motion relative to the spline member and the housing and wherein the floating nut is not radially secured to the housing or the spline member.

2. The system according to claim 1, further comprising a second floating nut mounted at an opposite end of the spline member relative to the piston, the second floating nut rotationally locking the spline member with an inner mandrel.

3. The system according to claim 2, wherein the second floating nut comprises straight splines cooperative with the inner mandrel permitting axial translation of the spline member relative to the housing and preventing rotational movement of the spline member relative to the inner mandrel.

4. The system according to claim 1, wherein the floating nut comprises an internal lateral spline positioned to impart the relative rotational movement with respect to the spline member and the floating nut during axial translation of the piston.

5. The system according to claim 1, further comprising:

a communication line routed through the orienting tool to enable signal communication through the orienting tool.

6. The system according to claim 5, wherein the communication line is allowed to twist during rotational positioning of the orienting tool.

7. The system according to claim 5, wherein the communication line is attached to a spring member to accommodate rotational positioning of the orienting tool.

8. The system according to claim 1, further comprising:

a bi-directional pump to create pressure sufficient to enable selective translation of the piston back and forth in an axial direction.

9. The system according to claim 1, wherein pressure applied to move the piston is dithered to reduced hysteresis.

10. The system according to claim 1, wherein the floating nut has sufficient clearance to remain substantially coaxial with a surrounding portion of the housing during changes in curvature of the orienting tool.

11. The system according to claim 1, wherein the floating nut comprises a non-galling material.

12. A system, comprising:

an orienting tool comprising an internal orientation assembly to orientate a tool face along a drill path, the internal orientation assembly comprising a floating piston and a splined member disposed through a floating nut which undergoes relative rotational movement with respect to the splined member when relative axial movement occurs with respect to the splined member and the floating nut when at least one of the splined member and the floating nut is acted on by the floating piston; and the floating piston, splined member, and floating nut being located radially between an inner mandrel and an outer housing, wherein the floating piston comprises at least a portion which is radially decoupled to radially float within the outer housing.

13. The system according to claim 12, wherein the splined member has external helical splines mated with internal helical splines of the floating nut.

14. The system according to claim 12, wherein the floating nut radially floats relative to the outer housing with sufficient clearance to remain substantially coaxial with a surrounding portion of the outer housing during flexing of the outer housing during a drilling operation.

15. The system according to claim 14, wherein the internal orientation assembly further comprises a second floating nut fixedly mounted to the splined member at an opposite end relative to the floating piston.

16. The system according to claim 15, wherein the second floating nut comprises straight splines oriented to slide along the inner mandrel in an axial direction and to prevent rotational movement of the splined member relative to the inner mandrel.

17. A method, comprising:

deploying an orienting tool with a drill bit in a wellbore on coil tubing, the orienting tool comprising a floating nut, a splined member, and a floating piston radially positioned between an outer housing and an inner mandrel, the splined member disposed through the floating nut and rotationally connected to the floating nut, wherein the floating nut is rotationally stationary relative to the outer housing;

inducing relative axial translation between the floating nut and the splined member in response to axially translating the floating piston; and inducing relative rotational movement between the outer housing and the inner mandrel in response to the relative axial translation between the floating nut and the splined member, wherein the splined member and the inner mandrel are maintained rotationally stationary relative to one another.

18. The method according to claim 17, wherein the floating piston comprises a two portion piston having a radially fixed portion and a floating portion, the floating portion being decoupled in a radial direction to accommodate relative rotation of the outer housing.

19. The method according to claim 17, wherein the inducing axial translation between the floating nut and the splined member comprises axially translating the piston and the floating nut within the outer housing.

20. The method of claim 17, further comprising a second floating nut connected between the splined member and the inner mandrel on an opposite side of the floating nut from the floating piston, wherein the second floating nut rotational locks the splined member with the inner mandrel.

* * * * *